US005176325A

United States Patent [19]

Vidusek

[11] Patent Number: 5,176,325

[45] Date of Patent: Jan. 5, 1993

[54] AIR ATOMIZING SPRAY NOZZLE ASSEMBLY

[75] Inventor: Daniel A. Vidusek, St. Charles, Ill.

[73] Assignee: Spraying Systems Co., Wheaton, Ill.

[21] Appl. No.: 699,686

[22] Filed: May 14, 1991

[51] Int. Cl.[5] ..... B05B 7/04

[52] U.S. Cl. ..... 239/419.3; 239/428; 239/432; 239/434; 239/591; 261/115; 261/78.2; 261/17; 261/DIG. 9; 55/5; 55/73

[58] Field of Search ..... 239/419.3, 422, 426, 239/427, 428, 432, 433, 434, 567, 591, DIG. 19; 261/115, 116, 118, 78.2, 17, DIG. 9; 423/244 A; 55/73, 5

[56] References Cited

U.S. PATENT DOCUMENTS

| | | | |
|---|---|---|---|
| 2,012,139 | 8/1935 | Peabody | 239/427 |
| 2,647,014 | 7/1953 | Edwards | 239/601 |
| 4,349,156 | 9/1982 | Haruch et al. | 239/432 |
| 4,584,147 | 4/1986 | Stehning | 239/DIG. 19 |
| 4,592,506 | 6/1986 | Capes et al. | 239/DIG. 19 |
| 4,815,665 | 3/1989 | Haruch | 239/432 |
| 4,989,788 | 2/1991 | Bendig et al. | 239/432 |

*Primary Examiner*—Andres Kashnikow
*Assistant Examiner*—Karen B. Merritt
*Attorney, Agent, or Firm*—Leydig, Voit & Mayer

[57] ABSTRACT

A spray nozzle assembly particularly adapted for directing a finely atomized slurry of hydrated lime for removing sulfur dioxide from flue gases. The nozzle assembly includes a nozzle body having a first pre-atomizing and mixing chamber into which pressurized liquid and air flow streams are directed for breaking down and pre-atomizing the liquid, an orifice plate at the downstream end of the first pre-atomization and mixing chamber for restricting the fluid flow into a second chamber defined by the orifice plate and spray tip, and a spray tip having a plurality of circumferentially spaced discharge orifices through which atomized liquid particles in the second chamber discharge in a substantially conical cloud-like spray pattern of finely atomized particles.

30 Claims, 2 Drawing Sheets

AIR ATOMIZING SPRAY NOZZLE ASSEMBLY

FIELD OF THE INVENTION

The present invention relates generally to spray nozzles, and more particularly, to spray nozzles of the type that are utilized for spraying lime slurries in gas desulfurization systems.

BACKGROUND OF THE INVENTION

It is known to spray slurries of hydrated lime into the discharging flue gases from coal powered furnaces or boilers, such as in electric power plants, for the purpose of capturing, reaction with, and removing sulfur dioxide from the gases prior to discharge to the atmosphere. To effectively scrub sulfur dioxide from such gases, it is necessary that the slurry be finely atomized into liquid particles of about 100 microns or less in diameter. It also is desirable that spray particles be of such small size in order to enhance drying prior to impinging upon the flue duct work so as to prevent build-up and corrosion. Heretofore, problems have been incurred in achieving sufficient and consistent atomization of such lime slurries. Existing spraying systems further have required relatively large capacity pressurized air sources, which are not always readily available or economically feasible, and the high speed direction of such slurries through the spray nozzle assemblies tends to create excessive wear to exposed surfaces of the nozzle.

OBJECTS AND SUMMARY OF THE INVENTION

It is an object of the present invention to provide an improved spray nozzle assembly adapted for more effectively discharging a finely atomized slurry of hydrated lime for enhanced scrubbing of sulfur dioxide in discharging flue gases. A related object is to provide a spray nozzle assembly of such type which is adaptable for producing a finely atomized lime slurry spray in which a substantial portion of the particles, by volume, have a diameter of 100 microns or less.

Another object is to provide a spray nozzle assembly as characterized above which has reduced air consumption requirements.

A further object is to provide a spray nozzle assembly of the foregoing type which is less susceptible to wear.

Yet another object is to provide a spray nozzle assembly of the above kind which is relatively simple in construction and operation and which lends itself to economical manufacture.

Other objects and advantages of the invention will become apparent upon reading the following detailed description and upon reference to the drawings, in which:

Figure 1:
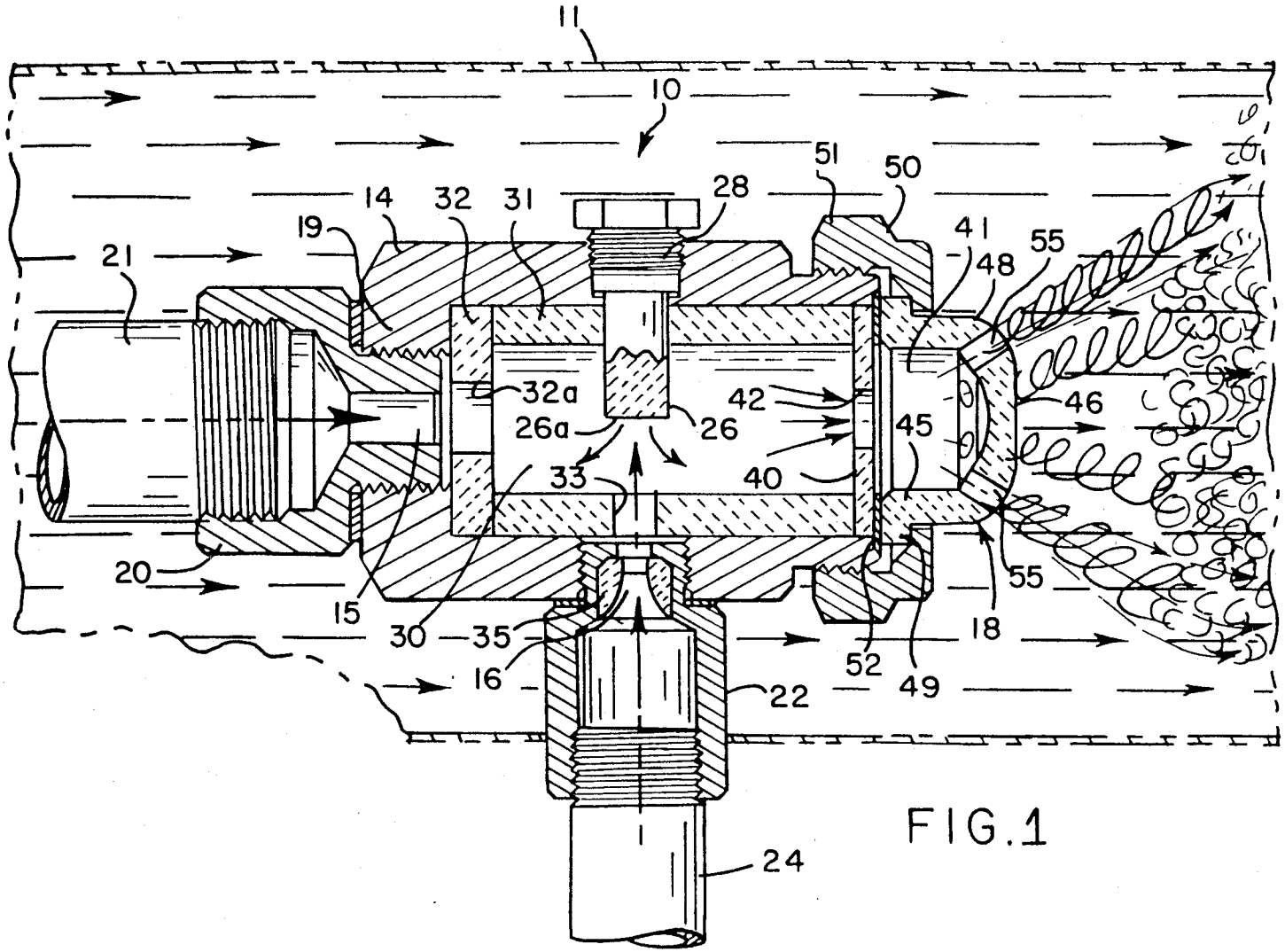
FIG. 1 is a vertical section of an illustrated spray nozzle assembly embodying the present invention.
Figure 2:
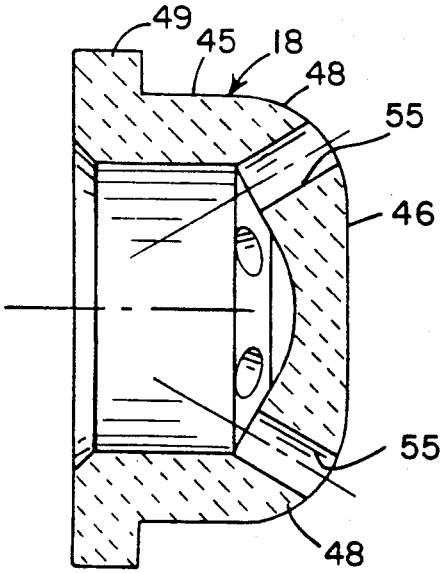
FIG. 2 is an enlarged vertical section of the spray tip of the nozzle assembly.
Figure 3:
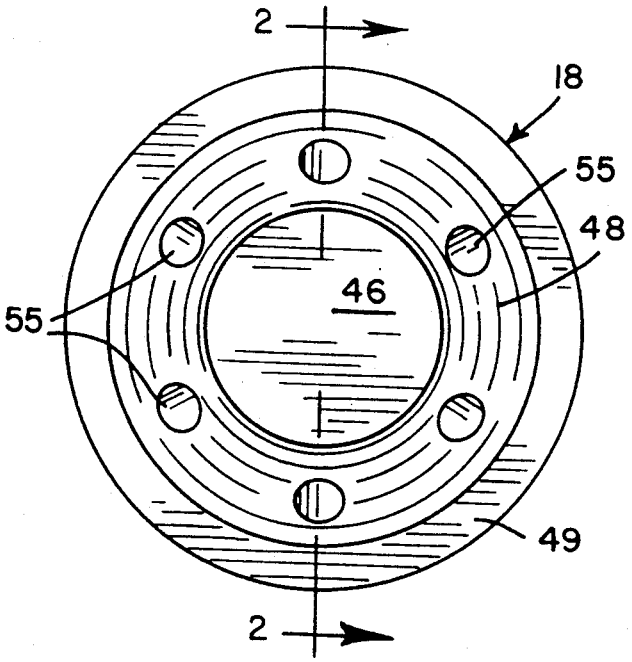
FIG. 3 is a front end view of the spray tip shown in FIG. 2.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring now more particularly to the drawings, there is shown an illustrative spray nozzle assembly 10 embodying the present invention adapted for spraying lime slurries in a flue duct 11, such as the exhaust duct of a coal fueled boiler in a power plant, for the purpose of removing sulfur dioxide from the rising flue gases. The nozzle assembly 10 includes a cylindrical body 14 having an air inlet 15 at an upstream end thereof, a lime slurry or liquid inlet 16 located intermediate the ends of the body 14, and a nozzle tip 18 at the downstream end thereof. The nozzle body 14 in this case has an end wall 19 at its upstream end into which an adaptor 20 for a pressurized air supply line 21 is threadedly engaged. An adaptor 22 for a liquid or lime slurry supply line 24 threadedly engages an underside of the body 14 approximately midway between its ends. Pressurized air from the supply line 21 is directed longitudinally through the body 14 from the air inlet 15, which in this case is defined by the adaptor 20, while pressurized liquid is introduced into the body through the liquid inlet 16 at an angle perpendicular to the longitudinal axis of the body 14 and the moving air stream for converging with the air stream.

For enhancing atomization of the converging liquid and air flow streams, an impingement post 26 extends into the body 14 in opposed relation to the liquid inlet 16. The post 26 in this case is mounted on the end of a screw-in support member 28 threadedly engaged in an aperture on the top side of the body 14 for selected positioning. The post 26 has an impingement face **26*a* at the terminal end thereof, preferably positioned on the axis of the air inlet 15, against which liquid introduced into the body from the liquid inlet 16 impinges. At the same time, the pressurized air stream directed longitudinally through the body 14 from the air inlet 15 sweeps across the impingement face 26*a*** to further break down and pre-atomize the liquid into relatively small particles which are turbulently directed through the body in a downstream direction.

For defining a first pre-atomizing, mixing and expansion chamber 30 and for protecting the interior of the nozzle body 11 from abrasive wear of the turbulently moving lime slurry, the body 14 has a cylindrical liner 31 and an upstream end-plate 32 both preferably formed of non-erosive material, such as ceramic. The end-plate **32*a* has a central aperture 32 slightly larger than the air inlet 15 so as not to impede the flow of pressurized air into the mixing chamber 30, and the cylindrical liner 31 has a liquid inlet opening 33 coaxial with and slightly larger than the liquid inlet 16 for permitting free passage of the liquid flow stream into the mixing chamber 30 from the liquid inlet 16. To further minimize wear, the liquid inlet 16 is defined by a ceramic insert 35 disposed within the adaptor 22 and the post 26 is a separate ceramic member affixed to the screw-in support 28**.

In accordance with the invention, the nozzle body has a downstream orifice plate or end wall formed with a relatively small diameter flow passageway, which together with the nozzle spray tip define a second mixing, atomizing and expansion chamber distinct from the first chamber whereby pre-atomized liquid particles in the first chamber are broken down further as they are directed through the small diameter flow passageway and impinge upon the walls of the second chamber prior to discharge from the spray tip. To this end, in the illustrated embodiment, the body 14 has a downstream end wall defined by an orifice plate 40, preferably also made of ceramic, and the spray tip 18 has a dome-shape which in cooperation with orifice plate 40 define a second mixing and expansion chamber 41. The orifice plate 40 defines a relatively small diameter flow passageway 42 axially aligned with the air inlet 15, preferably sized similar to or slightly larger than the air inlet 15 and less than one-half the diameter of the mixing and expansion chamber 30.

The spray tip 18 in this instance has a cylindrical side wall 45 and an end wall 46 connected to the side wall by a rounded or curved corner section 48 to create a generally domed shape. The nozzle tip 18 has an outwardly extending flange 49 at its upstream end to facilitate mounting of the nozzle tip 18 adjacent the downstream side of the orifice plate 40 by means of a retention cap 50 threaded onto an externally threaded downstream end of the body 14. The retention cap 50 preferably has a hex-shaped outer portion 51 to facilitate tightening and removal thereof by means of a wrench. An annular sealing gasket 52 is interposed between the nozzle body 14 and the spray tip 18.

Figure 4:
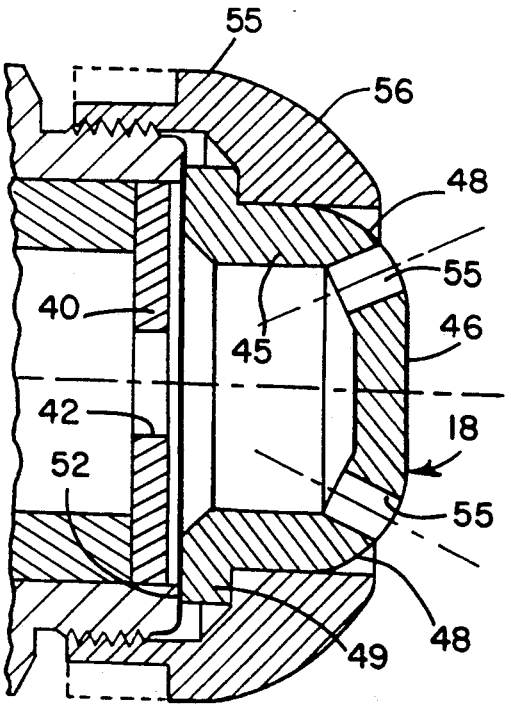
FIG. 4 is a fragmentary section of a nozzle assembly according to the invention having an alternative form of spray tip retention cap.

An alternative form of retention cap 55 is shown in FIG. 4, which has a forwardly extending, rounded and streamlined nose portion 56 disposed in close surrounding relation about the cylindrical wall 45 of the spray tip 18 for reducing the tendency for the discharging spray particles to be drawn onto and adhere to the outside of the spray tip 18, commonly referred to as "bearding." The streamlined nose portion 56 of the retention cap 55 is effective for reducing negative pressures adjacent the discharge orifices which can cause such bearding.

While the theory of operation is not entirely understood, it is believed that the orifice plate 40 maintains a sufficiently large pressure differential between the first chamber and second chambers 30, 41, such that the turbulently moving pre-atomized liquid particles within the first chamber 30 are caused to be directed through the relatively small diameter flow passage 42 in the orifice plate 40 at sufficient speed and force to cause shearing and further particle breakdown during entry into the second chamber 41 and upon impingement against the walls of the second chamber. Moreover, such further atomization unexpectedly has been achieved by the orifice plate 40 with reduced air flow requirements, thereby enabling lower capacity and lesser expensive pressurized air supplies.

In keeping with the invention, the spray tip is formed with a plurality of circumferentially spaced generally outwardly directed discharge orifices 55 each communicating with the chamber 41 such that a plurality of circumferentially spaced streams of finely atomized liquid particles discharge from the spray tip to initially form a generally hollow cone spray pattern, but which quickly drift and intermingle into a substantially continuous full cone pattern as the discharging spray proceeds from the nozzle tip, thereby forming a cloud of fine liquid particles for effectively capturing and reacting with sulfur dioxide in flue gases The discharge orifices 55 in the illustrated embodiment each extend through the curved spray tip section 48 at an angle of about 30 degrees to the longitudinal axis of the nozzle body. The nozzle tip 18 preferably has between four and eight equally spaced discharge orifices 55, and most preferably, six circumferentially spaced orifices as shown. Such a multiplicity of discharge orifices 55 create further nozzling and particle break down as the individual flow streams discharge into the atmosphere, and by virtue of the outwardly directed orientation of the individual orifices, the spray pattern initially resembles a hollow cone spray with the cone quickly filling in to form a substantially continuous cloud of particles as the spray proceeds from the tip.

In practice, it has been found that the spray nozzle assembly 10 of the present invention may be employed for spraying lime hydrate slurries in a finely atomized spray, with a substantial portion of the particles by volume being less than 100 microns in diameter. When spraying lime hydrates, the discharging cloud of finely atomized liquid particles effectively capture sulfur dioxide in the rising flue gases, while the small particle size of the spray cloud permits relatively quick evaporization so as to minimize undesirable impingement and build-up of potentially corrosive liquid on the flue duct work.

From the foregoing, it can be seen that the spray nozzle of the present invention is adapted for effectively discharging a finely atomized slurry of hydrated lime for enhanced scrubbing of sulfur dioxide in discharging flue gases of coal fueled power plants. The nozzle assembly has both reduced air consumption requirements and is less susceptible to wear. The nozzle also is relatively simple in construction and operation and lends itself to economical manufacture.

What is claimed is:

1. A spray nozzle assembly comprising a nozzle body defining a first pre-atomization and mixing chamber, means defining an air inlet orifice through which a pressurized air stream is directed into said first chamber, means defining a liquid inlet orifice through which a pressurized liquid stream is directed into said first chamber and with the assistance of said pressurized air stream is broken down into pre-atomized liquid particles, an end wall at a downstream end of said first chamber formed with a reduced diameter orifice, a spray tip on an end of said body, said spray tip and end wall defining a second atomizing and mixing chamber into which pre-atomized liquid particles from said first chamber are directed via said end wall orifice, said spray tip having an uninterrupted end wall impingement surface area in axial alignment with and of larger area than said reduced diameter orifice against which pre-atomized liquid particles passing through said reduced diameter orifice are directed, and said spray tip having a plurality of discharge orifices disposed about said uninterrupted impingement surface area through which atomized liquid particles in said second chamber discharge as a spray pattern of finely atomized particles.

2. The spray nozzle assembly of claim 1 in which said spray tip discharge orifices are arranged in a circumferentially spaced array about said spray tip impingement surface area.

3. The spray nozzle assembly of claim 2 in which said spray tip is dome shaped.

4. The spray nozzle assembly of claim 2 in which said discharge orifices extend through the spray tip in outwardly extending angles relative to a longitudinal axis of the spray tip.

5. The spray nozzle assembly of claim 4 in which said spray tip includes a curved wall section through which said discharge orifices are formed.

6. The spray nozzle assembly of claim 2 in which said spray tip is dome shaped having a generally cylindrical side wall, a downstream end, a curved wall section connecting said side and end walls, said discharge orifices extending through said curved wall section.

7. The spray nozzle assembly of claim 2 in which said spray tip is formed with between four and eight circumferentially spaced discharge orifices.

8. The spray nozzle assembly of claim 2 in which said spray tip is formed with six discharge orifices.

9. The spray nozzle assembly of claim 1 in which said end wall is defined by an orifice plate mounted at a downstream end of said nozzle body.

10. The spray nozzle assembly of claim 9 in which said second chamber has a diameter at least twice the diameter of said end wall orifice.

11. The spray nozzle assembly of claim 10 in which said end wall orifice is at least as large as said air inlet orifice.

12. The spray nozzle assembly of claim 11 in which said air inlet orifice and end wall orifice are on a common longitudinal axis of said body.

13. The spray nozzle assembly of claim 12 in which said liquid inlet orifice directs liquid at an angle of about 90 degrees to the longitudinal axis of said nozzle body.

14. The spray nozzle assembly of claim 1 in which said spray tip has an outwardly extending annular flange, and a retention cap engageable with said flange for releasably securing said spray tip to said body adjacent said end wall.

15. The spray nozzle assembly of claim 14 in which said cap has a forwardly extending, rounded nose portion closely surrounding the sides of said spray tip.

16. The spray nozzle assembly of claim 1 including an impingement member extending into said first chamber against which liquid introduced into said first chamber from said liquid inlet orifice impinges.

17. The spray nozzle assembly of claim 16 in which said impingement member has an impingement surface located substantially on the longitudinal axis of said body and over which said pressurized air stream directed into said first chamber from said air inlet orifice passes.

18. The spray nozzle assembly of claim 1 in which said nozzle body has a substantially non-erosive lining, and said end wall and spray tip are made of substantially non-erosive material.

19. The spray nozzle assembly of claim 18 in which said nozzle body lining comprises a cylindrical member having an inlet aperture in alignment with said liquid inlet orifice through which said pressurized liquid stream is directed into said first chamber, and an end plate adjacent an upstream end of said cylindrical member having an inlet aligned with said air inlet orifice through which said pressurized air stream directed into said first chamber passes.

20. A spraying system for removing sulfur dioxide from flue gases comprising a flue through which gases containing sulfur dioxide are directed, a nozzle assembly including a nozzle body which defines a first pre-atomizing and mixing chamber, means for directing a pressurized air stream into said first chamber, means for directing a liquid stream of lime slurry into said first chamber which with the assistance of said pressurized air stream is broken down into pre-atomized liquid particles, an end wall at a downstream end of said first chamber formed with a reduced diameter orifice, a spray tip on an end of said body, said spray tip and end wall defining a second atomizing and mixing chamber into which pre-atomized liquid particles from said first chamber are directed via said end wall orifice, said spray tip having an end wall impingement surface area in axial alignment with said reduced diameter orifice against which pre-atomized liquid particles passing through said reduced diameter orifice are directed, and said spray tip having a plurality of discharge orifices disposed about said impingement surface area through which atomized liquid particles in said second chamber discharge into said flue as a spray in which a substantial portion of the particles are less than 100 microns in diameter.

21. The spray nozzle assembly of claim 20 in which said spray tip discharge orifices are arranged in a circumferentially spaced array about said spray tip impingement surface area, said orifices extending outwardly at an angle to a longitudinal axis of the spray tip.

22. The spray nozzle assembly of claim 21 in which said spray tip is dome shaped.

23. The spray nozzle assembly of claim 20 in which said spray tip is formed with six discharge orifices.

24. The spray nozzle assembly of claim 20 in which said end wall is defined by an orifice plate mounted at a downstream end of said nozzle body.

25. The spray nozzle assembly of claim 24 in which said second chamber has a diameter at least twice the diameter of said end wall orifice, and said end wall orifice is at least as large as said air inlet orifice.

26. The spray nozzle assembly of claim 25 in which said air inlet orifice and end wall orifice are on a common longitudinal axis of said body.

27. The spray nozzle assembly of claim 25 in which said liquid inlet orifice directs liquid at an angle of about 90 degrees to the longitudinal axis of said nozzle body.

28. The spray nozzle assembly of claim 20 including an impingement member extending into said first chamber against which liquid introduced into said first chamber from said liquid inlet orifice impinges.

29. A spray nozzle assembly comprising a nozzle body defining a first pre-atomization and mixing chamber, means defining an air inlet orifice through which a pressurized air stream is directed into said first chamber, means defining a liquid inlet orifice through which a pressurized liquid stream is directed into said first chamber and with the assistance of said pressurized air stream is broken down into pre-atomized liquid particles, an end wall at a downstream end of said first chamber formed with a reduced diameter orifice, a spray tip on an end of said body, said spray tip and end wall defining a second atomizing and mixing chamber into which pre-atomized liquid particles from said first chamber are directed via said end wall orifice, said second chamber having a diameter at least twice the diameter of said end wall orifice, and said spray tip having a plurality of discharge orifices through which atomized liquid particles in said second chamber discharge as a spray pattern of finely atomized particles.

30. The spray nozzle assembly of claim 29 in which said spray tip has an end wall impingement surface area in axial alignment with said reduced diameter orifice against which pre-atomized liquid particles passing through said reduced diameter orifice are directed.

* * * * *